United States Patent [19]

Grupping

[11] 4,243,101

[45] Jan. 6, 1981

[54] COAL GASIFICATION METHOD

[76] Inventor: Arnold W. J. Grupping, Anjelierenlaan, 3, Aerdenhout, Netherlands

[21] Appl. No.: 939,031

[22] Filed: Sep. 1, 1978

[30] Foreign Application Priority Data

Sep. 16, 1977 [NL] Netherlands ..... 7710184

[51] Int. Cl.[2] ..... E21B 43/24; E21B 43/26; E21C 43/00

[52] U.S. Cl. ..... 166/261; 166/52; 166/258; 166/259; 48/DIG. 6

[58] Field of Search ..... 166/261, 259, 52, 258, 166/292; 299/2, 4; 48/DIG. 6

[56] References Cited

U.S. PATENT DOCUMENTS

| | | | |
|---|---|---|---|
| 2,481,051 | 9/1949 | Uren | 299/2 |
| 3,010,512 | 11/1961 | Hurley et al. | 166/261 X |
| 3,010,707 | 11/1961 | Craighead et al. | 166/261 X |
| 3,034,580 | 5/1962 | Frey et al. | 166/261 |
| 3,331,438 | 7/1967 | Slusser | 166/261 |
| 3,566,967 | 3/1971 | Shelton et al. | 166/261 |
| 3,999,607 | 12/1976 | Pennington et al. | 166/261 X |
| 4,102,397 | 7/1978 | Terry | 299/2 X |

FOREIGN PATENT DOCUMENTS

| | | | |
|---|---|---|---|
| 697189 | 9/1953 | United Kingdom | 48/DIG. 6 |

*Primary Examiner*—Stephen J. Novosad
*Attorney, Agent, or Firm*—William A. Drucker

[57] ABSTRACT

A method for underground gasification of coal or brown coal, in which a substantially uniform gasification or combustion front is maintained by filling the cavity generated by gasification of coal with a filler so as to drive said front in an upward direction through the coal layer, the gases for maintaining the gasification being introduced through a first borehole and the combustion gases being discharged through a second borehole, one of these boreholes being used for introducing the filler, said boreholes extending at an inclination corresponding to the general inclination of the coal layer, and preferably converging towards one another.

1 Claim, 7 Drawing Figures

COAL GASIFICATION METHOD

The invention relates to the production of combustible gases from subterranean coal or brown coal layers by gasification thereof, to which end air and/or oxygen is introduced into these layers through boreholes, and the combustible reaction gases are returned towards the surface through second boreholes, the reaction front being driven in an upward direction in the coal layer by filling the cavities thus formed with a filler.

It is known that coal and brown coal can be exploited by the process of in-situ gasification. To this end at least one supply hole is drilled or dug towards the coal deposit, as well as at least one discharge hole, after which an underground connection between these two holes is created in the deposit.

According to the present state of the art, such a connection can be established in various ways, for instance by man-power, by pumping in a liquid or a gas at high pressure, by applying an electric voltage etc.

After the connection has been established, air, oxygen or a mixture of both gases, if required mixed with water or steam, is injected into the supply hole, and is pressed through the connecting channel or channels towards the discharge hole, and flows back through the latter hole towards the surface. By considerable increasing the temperature in the coal layer, the coal begins to react with the supplied gases, as a result of which combustible gases are generated, such as carbon monoxide, hydrogen gas and hydrocarbons.

Through the years many modifications of the gasification process have been developed, such as, for instance, alternating injection and production through the injection and discharge holes respectively, gasification with the forward line-burn, the reverse line-burn or the longwall method, injection of the above-mentioned gases and liquid in different ratios, variation of the pressure, introduction of additional water through the supply hole or the discharge hole, various configurations of the supply and discharge holes, in horizontal as well as in inclined layers, and introduction of fillers into the cavities that have developed to avoid or reduce the collapse of the overlying rock.

All these methods or combinations of methods have, however, the disadvantage that the maximum amount of coal that can be gasified underground with each pair of boreholes is so small that, in the greater part of the cases, the process appears to be not or hardly economically remunerative. The cause of this is, on the one hand, that the distance between the supply hole and the discharge hole in the coal layer should not be made too large, because, otherwise, the connection between both in the coal layer cannot be established at all or only at great cost. On the other hand, the cross-sectional area of the cavity created by the gasification of the coal should not become too large since, otherwise, the gasification process comes to a standstill by too large heat losses from the circulating gases towards the overlying and underlying rock, and by too little contact of the oxygen in the circulating gases with the coal. Thus, the length and the cross-sectional area, and therefore the volume of the coal or brown coal to be gasified, is limited.

The purpose of the invention is to establish a method and a system for underground gasification of coal or brown coal layers, so as to produce combustible gases therefrom, this in such a manner that it becomes possible to gasify between each pair of boreholes a very much larger volume of coal or brown coal than is possible with presently known methods, and in this way the gasification process can be made economically feasible in many instances up to great depths.

Because a filler is used to fill the cavities formed by gasifying the coal or brown coal, in order to drive the reaction in an upward direction, an additional benefit is that the overlying rock does not collapse, so that no or very little subsidence will occur at the surface.

The method consists in drilling and casing boreholes, employing techniques and diameters currently used in oil industry. These boreholes are deviated in such a manner that they penetrate a coal layer at such a small angle that these boreholes can then be continued through this coal layer by employing known drilling techniques. This is promoted by the fact that coal is much softer and also more brittle than the surrounding rock.

To use this method it is necessary that the coal layer includes a certain angle with the horizontal plane, and that the boreholes penetrate the coal layer in a downward direction.

The length of the section of the boreholes in the coal layer is variable, and will, for instance, depend on geological conditions such as the presence of fractures in the surrounding rock and in the coal. The boreholes can be directed parallel to each other in the coal layer, but in many cases it will be more advantageous if pairs of boreholes enter the coal layer at a considerable mutual distance and are then made to approach each other gradually, so that, at their deepest point, they are very close together. This is shown schematically in FIGS. 1 and 2. In FIG. 1 the boreholes in the coal section run parallel to each other, whereas in FIG. 2 they have been deviated towards each other. This second method has the advantage that the connection between both boreholes, which is required to start the gasification process, can be more easily established, and, at the same time, a large volume of coal can be gasified, as will be explained below.

The casings in the boreholes can be inserted either down to the bottom of the boreholes or to a less deeply situated point, but extend preferably at least to the spot where the boreholes enter the coal layer.

In the boreholes provisions will be made above the coal layer as used in oil industry, enabling, after completing the gasification of the coal between both boreholes, to plug these boreholes and to drill deviated holes, starting from higher points, so as to work the same coal layer in other points or, as the case may be, another coal layer. The latter possibility is shown schematically in FIG. 3 for a three-layer system.

If the boreholes have been cased with pipes, these casings are perforated at or near the deepest point, after which a connection can be made between both holes through the coal in one of the known manners, after which the gasification process can be started. One of the boreholes then serves for supplying the gases. The other borehole serves to discharge the produced gases.

With a continued air or oxygen supply the gasification of the coal will, after some time, result in the creation of a cavity of irregular shape near the deepest point of both boreholes. As a result, more heat losses will take place in the overlying and underlying rock, and the injected air or oxygen will gradually obtain such a low flow velocity that not all the oxygen will come into contact with the burning coal any longer.

Consequently, the gasification process will gradually come to a halt.

In order to prevent this, a filler, such as, for instance, sand or a suspension of sand in water, is introduced into the cavity through the supply and/or the discharge borehole. This can be done by adding the filler to the air or oxygen at the surface, or through a separate pipe or an annular space into the supply and/or the discharge borehole.

Because of the inclination of the coal layer and the effect of the gravity force, with or without the blowing action of the air or oxygen, the filler will collect at the bottom of the cavity, and will fill this cavity from the bottom upwards. Thus the gasification front cannot propagate itself anymore in the downward direction, but only upwards.

If the supply and discharge boreholes diverge upwardly, as sketched in FIG. 2, the gasification front will gradually widen, so that, as the time goes by, more air or oxygen can be usefully injected.

After the first cavity has been formed, additional connections with the coal are made in both boreholes by perforating the casings, which connections are successively freed as the gasification front moves upwards. These additional perforations could also be made at the same time as the first-mentioned lowest perforations. In sections in which the boreholes are not cased with pipes, perforations would not be required at all.

The filler can be introduced continuously or discontinuously, and its concentration per $m^3$ of injected air or oxygen can be varied. It is also possible to introduce various different fillers one after the other.

The filler can consist of dry granular solid material, such as, for instance, sand, soil or ground stone, or it can consist of a slurry or suspension such as cement, concrete, a sandwater slurry or a mud, such as used in the drilling of oil wells, or a combination of these solid materials or suspensions. By introducing a liquid filler it is achieved that the gasification front will assume a more or less horizontal position.

By using the correct amounts of solid filler at the correct moments the combustion front can, to a certain extent, be given a certain desired inclination.

By varying the velocity of the injected gases and the amount of filler introduced per unit of time, the width of the channel between the coal and the filler can be increased or decreased at the same time, as a result of which the stresses in the coal can be varied, so that the coal will cleave and be gasified more easily.

The filler serves, moreover, to prevent or oppose the collapse of the overlying rock, and, thus, subsidences at the surface.

If the filler is liquid, substances can be added thereto, adapted to accelerate or to retard its setting at the prevalent high temperatures, and/or to change its rheological properties.

The setting of cement or concrete can, for instance, be retarded by adding calcium lignosulfonates. The rheological properties can be influenced by adding, for instance, bentonite (gel cement).

Fillers such as a sand slurry or a mud can be given plastering properties, so that water cannot penetrate therefrom into underlying granular fillers already present. Also substances can be added to a mud for promoting gelling thereof after some time, so that granular fillers introduced later will bear thereon without sinking away therein.

For influencing the plastering effect and the viscosity of slurries and muds many additions are known from the well-drilling art, such as starches, phosphates, thinners, lignosulfonates, carboxy-methylcelluloses, special clays etc.

The amount of water added to a liquid filler can be varied within certain limits in order to have the filling and gasification processes evolve together in an optimal way.

The invention will now be explained by reference to the drawings, showing an embodiment of the invention solely by way of example.

IN THE DRAWINGS

Figure 1:
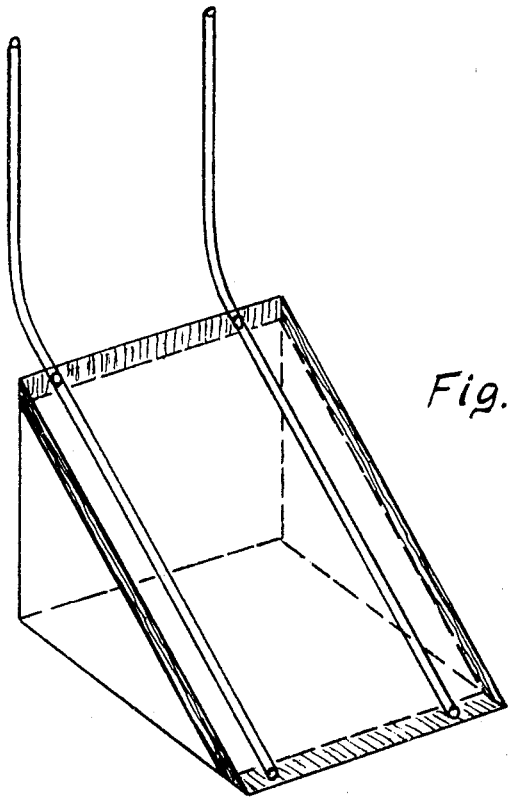
FIG. 1 is a perspective schematic illustration of an inclined coal seam in which bore holes are driven in parallel paths into the seam.
Figure 2:
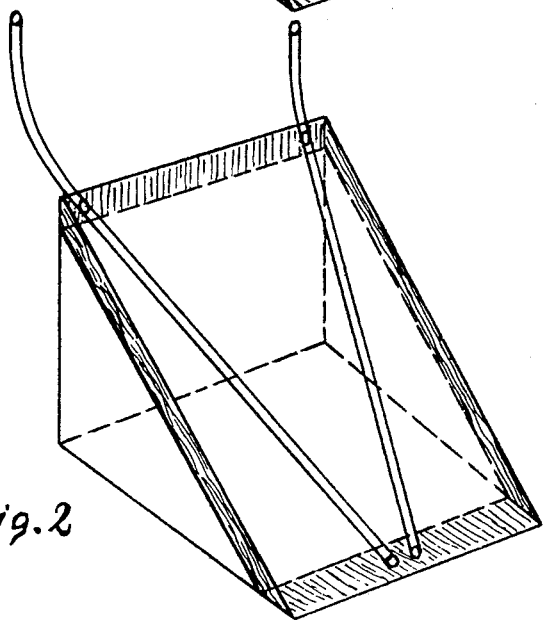
FIG. 2 is a perspective schematic illustration of an inclined coal seam in which bore holes are driven in convergent paths into the seam.
Figure 3:
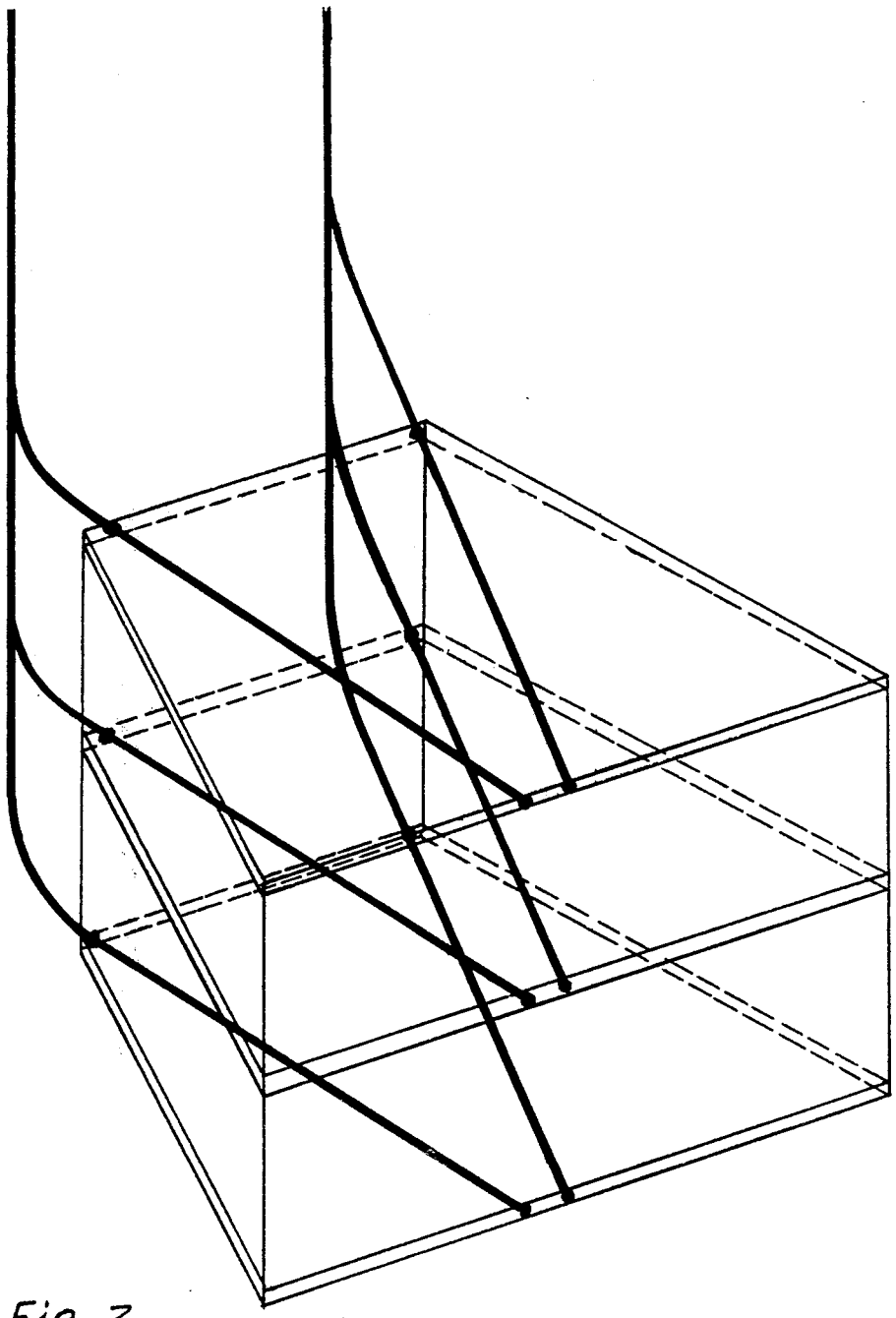
FIG. 3 is a perspective schematic illustration showing three convergent pairs of holes driven into the coal at different heights from a pair of bore holes.
Figure 4:
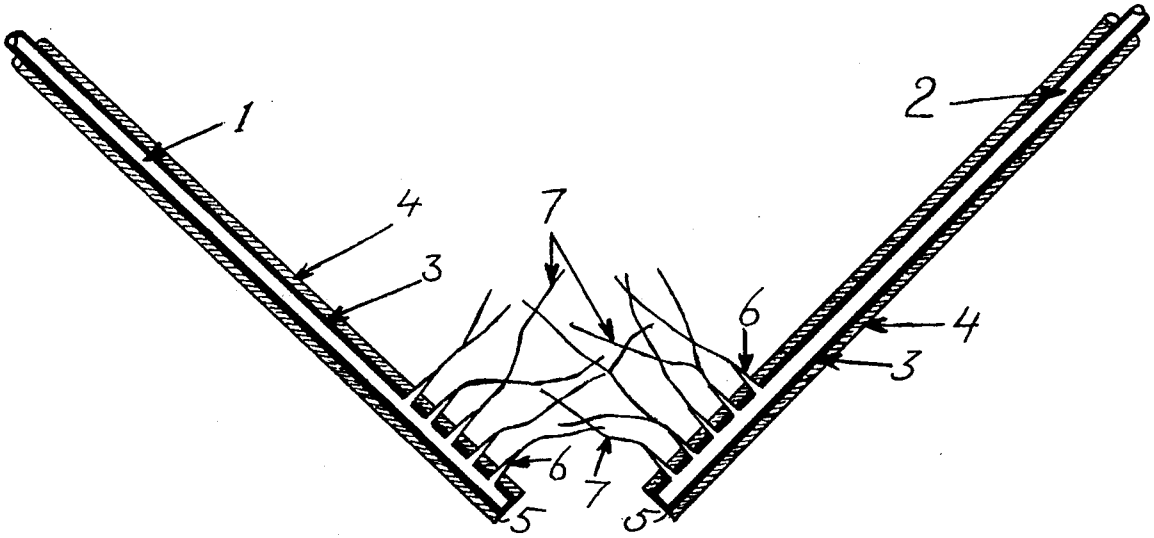
FIG. 4 is a view from above of the convergent arrangement of FIG. 2, viewed perpendicular to the plane of the inclined coal seam, showing a first stage of operation.

FIG. 4 shows a view of two boreholes seen from above perpendicular to the plane of the seam in FIG. 2, viz. an injection hole 1 and a production hole 2, the shown lower parts of which having been drilled in a downward direction into a coal layer. Both boreholes are cased with pipes 3 anchored with cement 4 to the coal wall of the borehole. The distance between the bottoms 5 of the boreholes is a few meters. Near the bottom of each borehole a number of perforations 6 are made, so that connections are created between the inside of the casings in the boreholes and the coal outside said holes.

By injecting air or liquid under pressure, fractures 7 are created, through which connections between the two boreholes will be formed.

Figure 5:
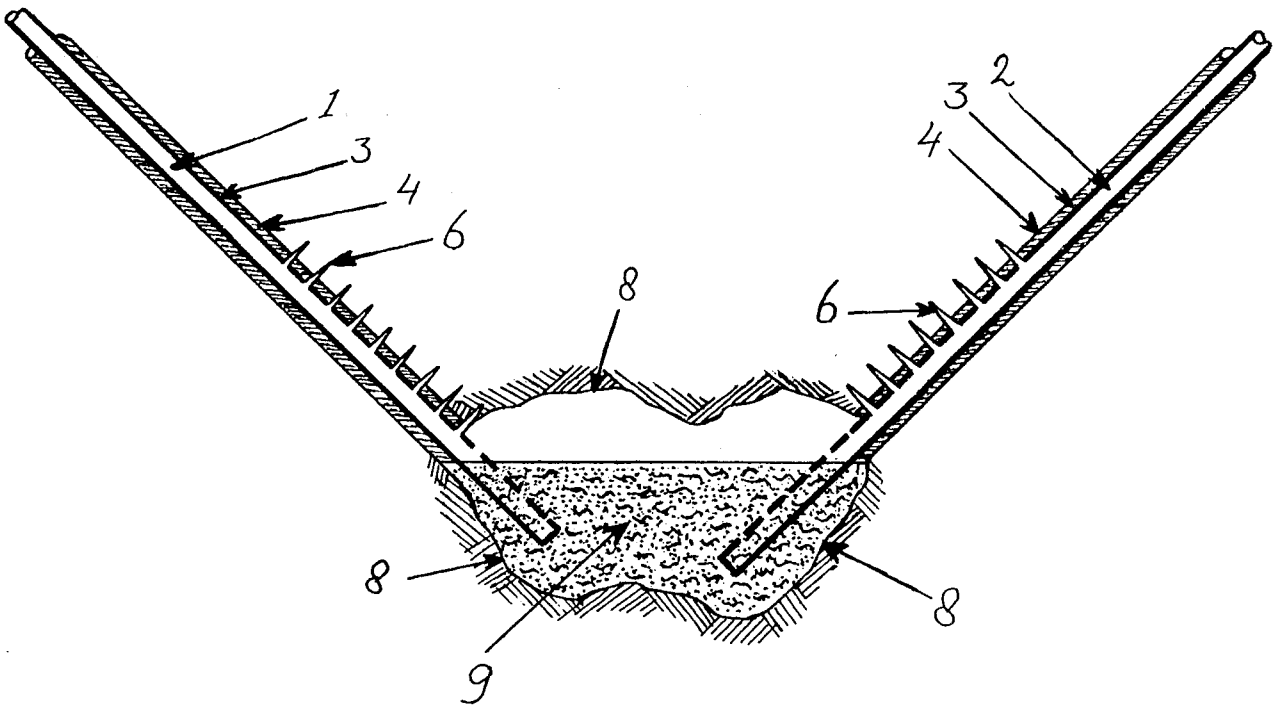
FIG. 5 is a view similar to that of FIG. 4 and showing a further stage of operation.

After ignition, the coal layer is gasified by injecting air from the surface into borehole 1, and withdrawing the produced gases through borehole 2, so that a cavity of irregular shape 8 will develop, as shown in FIG. 5. The injection of air is, then, temporarily discontinued, and the cavity 8 is partly filled through the injection borehole 1 with a cement slurry 9 assuming a more or less horizontal upper surface and hardening in the cavity 8.

Subsequently, additional perforations 6 are shot through the casings 3 and the cement 4 in higher locations in the boreholes 1 and 2.

Figure 6:
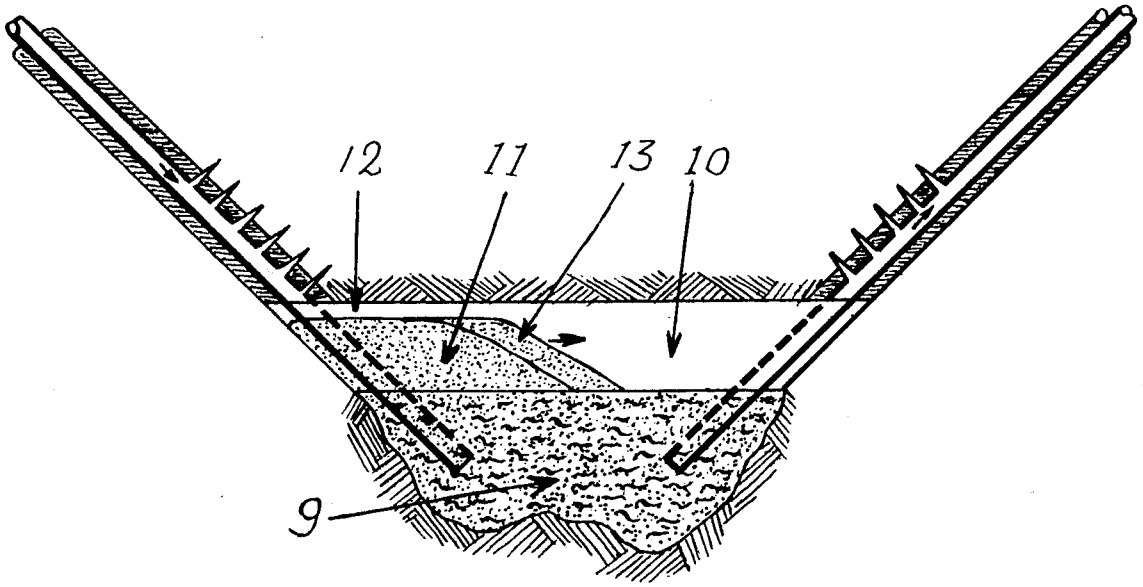
FIG. 6 is a view similar to that of FIG. 4 and showing a still further stage of operation.

The gasification process is, then, continued, with the result that the gasification front will be displaced upwards, so that a more or less horizontal channel 10 between the boreholes 1 and 2 will be obtained, as shown in FIG. 6.

Sand is now injected through the injection borehole 1 together with the gas flow. This sand collects initially in a heap 11 near the bottom of the injection borehole. By injecting more and more sand, sand is blown away by the gas flow from the narrow opening 12, and will collect further away in the channel at 13.

Sufficient sand is added to the injection gas to fill the channel 10 completely, but for a narrow opening 12 at the upper side, through which the gases keep flowing. Provisions are made that always so much sand is added that the surface of the sand moves upwardly parallel to itself through the layer where the coal is burned away with approximately the same speed as the gasification front.

Figure 7:
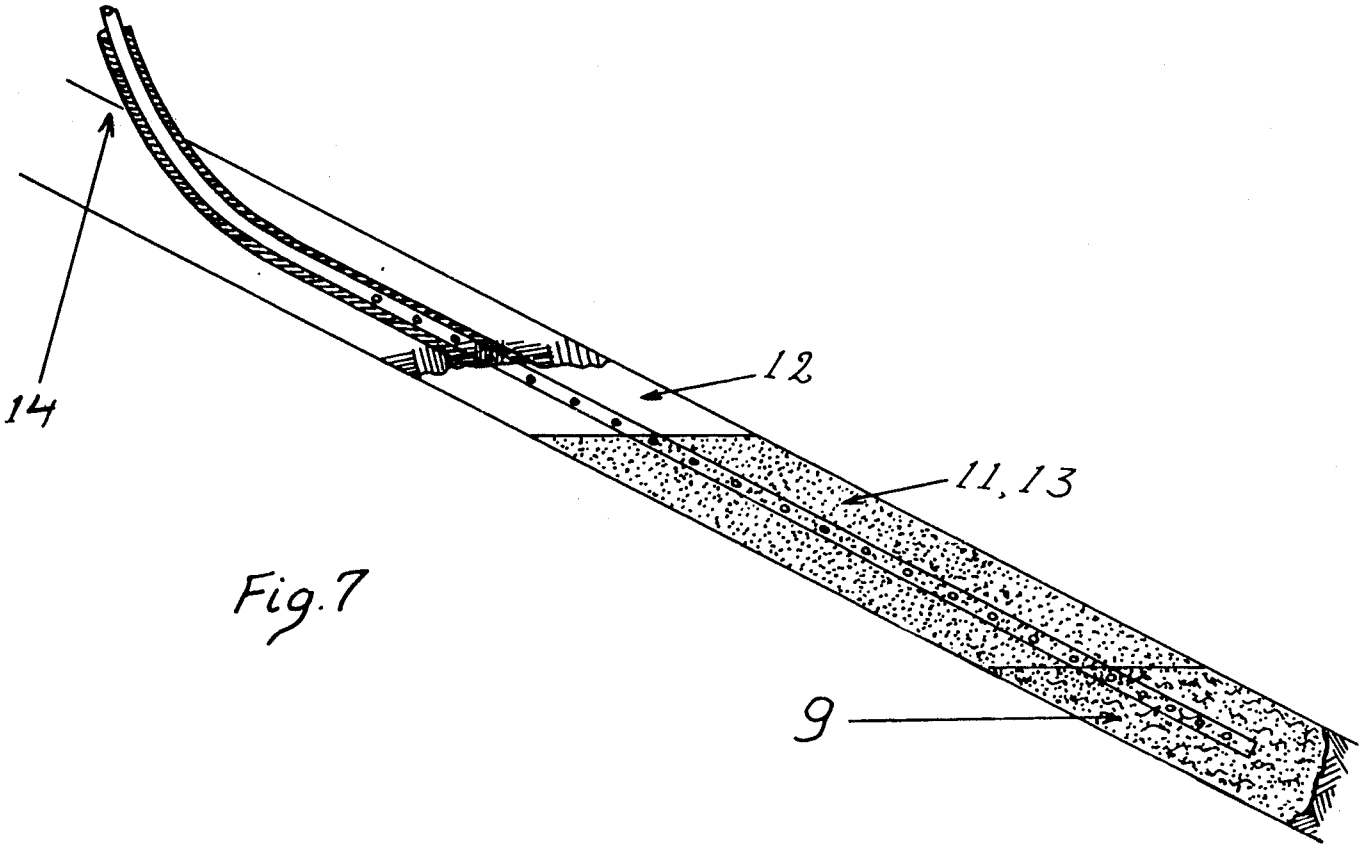
FIG. 7 is a side view of the stage of FIG. 6.

FIG. 7 shows a side-view of the situation after some time has lapsed. It will be clear that the gasification process will stop as soon as the sand body in the injection hole, in the production hole or in both will reach the point 14 where these holes enter into the coal layer.

I claim:

1. In a method for the underground gasification of coal or brown coal, of the kind comprising drilling boreholes in a downward direction along the dip of an inclined coal layer having overlying rock formation, passing gas downwardly in an injection borehole and withdrawing combustion gas from a production borehole, with development of a cavity in the coal layer providing communication between the boreholes, the improvement comprising:

(i) drilling boreholes in such a way that the horizontal distance between the boreholes becomes progressively smaller with their depth along the dip of the coal layer, (ii) initiating gasification at or near to the deepest point reached by the boreholes, (iii) introducing filler material into the developing cavity so that the gasification front is caused to move in an upward direction along the dip of the coal layer, said filler material being of such nature and composition as to resist or prevent caving in of the overlying rock formation and any surface subsidence which might result therefrom, (iv) after gasification of a first portion of the coal layer has been completed, plugging back said boreholes and deviating said boreholes starting from a higher point of the boreholes to reach and extend into and along the dip of another portion of the coal layer, or another coal layer.

* * * * *